United States Patent [19]

Pistorius et al.

[11] Patent Number: 4,869,435

[45] Date of Patent: Sep. 26, 1989

[54] POCKET PAPER SHREDDER

[76] Inventors: Gary M. Pistorius, 245 N. Illinois, Springfield, Ill. 62702-4827; David A. Vrtol, 1406 E. Broadway, Mesa, Ariz. 85204

[21] Appl. No.: 288,973

[22] Filed: Dec. 23, 1988

[51] Int. Cl.[4] ..... B02C 18/00

[52] U.S. Cl. ..... 241/100; 241/236

[58] Field of Search ..... 241/100, 168, 169.1, 241/235, 236; 83/459, 614, 618

[56] References Cited

U.S. PATENT DOCUMENTS

| | | | |
|---|---|---|---|
| 3,620,461 | 11/1971 | Pelleschi | 241/100 |
| 3,894,697 | 7/1975 | Lawson et al. | 241/236 X |
| 4,192,467 | 5/1980 | Hatanaka | 241/100 |
| 4,257,565 | 3/1981 | Hatanaka | 241/100 |
| 4,700,902 | 10/1987 | Yeomans | 241/100 |

*Primary Examiner*—Timothy V. Eley

*Attorney, Agent, or Firm*—Lewis E. Massie

[57] ABSTRACT

A portable pocket size paper shredder housing having a paper entrance slot on the front end with an enclosed trough leading to a pair of shredding rollers and an exit slot on the back end. A first shredding roller comprising a circular drive shaft covered with a compressible, fractional material. The second shredding roller having a plurality of thin circular cutting knives axially spaced on the drive shaft. The spacers being of a compressible frictional material. The first shredding roller having circumferential slots matching the edges of the cutting knives. The coacting shredding rollers coupled to an electric motor drive by associated gearing means.

2 Claims, 2 Drawing Sheets

POCKET PAPER SHREDDER

BACKGROUND OF THE INVENTION

1. Field of the Invention

The act of cutting paper documents into narrow strips is commonly referred to as shredding. The shredding of documents is considered to be essential for destroying classified documents, documents referring, to credit card accounts and other confidential papers. Many shredding machines have been proposed including large stand alone machines and smaller desk top machines. In most business and government offices a substantial amount of paper work is considered to be harmful to the best interests of the establishment if disclosed.

2. Description of the Prior Art

Shredding machine described in the prior art use meshing circular cutting means or an arrangement of sliding knife blades to shred paper passing beneath the cutting means. U.S.Pat. No. 2,409,203 Gale, describes a shredding machine for slicing a cellulosic material using razor blades passing through slots with the material to be shredded between the blades and the slots. A similar design is described by Cassidy in U.S. Pat. No. 1,798,645. Pertinent to the present invention is U.S.Pat. No. 3,620,461 Pelleschi. The Pelleschi patent describes a pair of cooperating shearing rolls each having a plurality of substantially parallel cutting edges which shred paper passing between the cutting edges.

SUMMARY OF THE INVENTION

The present invention describes a small pocket size paper shredder that can be carried in a pocket or briefcase. The shredder designed to shred credit card carbons and other small documents, achieves the shredding action by a plurality of circular knives axially arranged along a rotating shaft coacting with a second member made of spaced circular rubber or plastic rollers axially spaced along a second rotating shaft having spacings accommodating the circular knives. The two rotating shafts simultaneously driven by an electric motor.

The coating rotating members are mounted transversely in a case having a trough extending from the front end of the case to the cutting edges and then from the other side of the cutting edges to the back end of the case. The exit slot on the back end of the case enclosed by a snap-on cover for retaining the shredded papers. The rotating shafts of the shredding mechanism coupled by gear means to the driving electric motor. The electric motor having a step down gear arrangement to reduce the rotational speed and to increase the output torque.

The power supply module for operating the electric motor optionally can contain batteries or an electronic converter for converting the house voltage to d.c. voltage suitable for operating the electric motor. Electric switches are provided in the case for exciting and reversing the electric motor.

DETAILED DESCRIPTION OF THE PREFERRED EMBODIMENT

Figure 1:
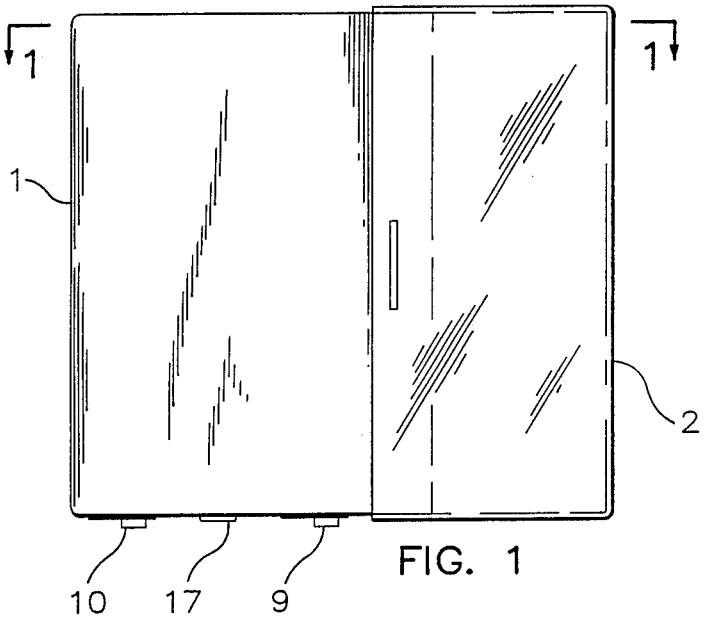
FIG. 1 is a plan view of the pocket shredder.
Figure 3:
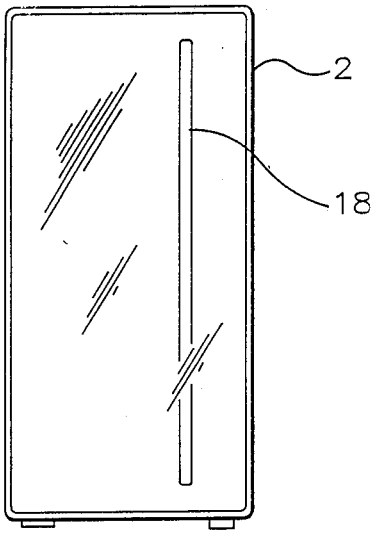
FIG. 3 is a back view of the pocket shredder.
Figure 2:
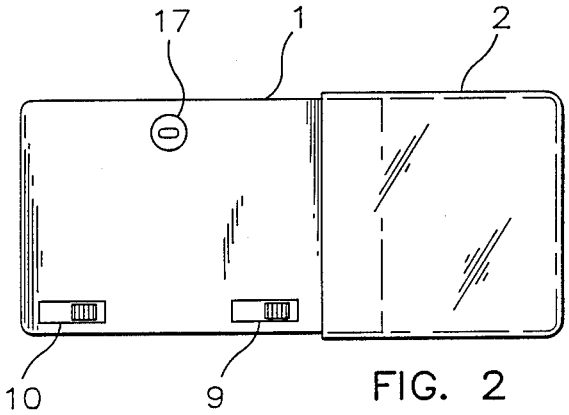
FIG. 2 is a right side view of the pocket shredder.
Figure 4:
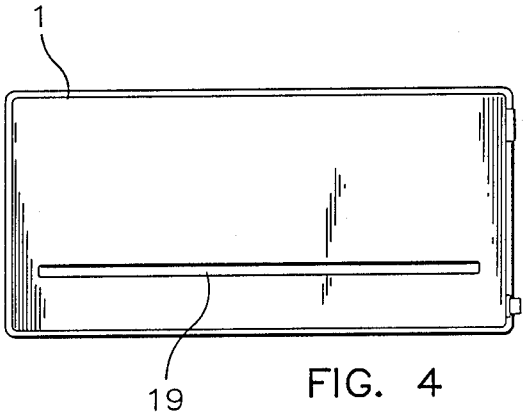
FIG. 4 is a front view of the pocket shredder.

The plan view of FIG. 1 shows the shredder case 1 with the snap-on collecting enclosure 2. FIG. 2 shows the shredder case 1, the collecting enclosure 2, the power cord grommet 17, the on/off switch 10 and the reverse switch 9. FIG. 3 shows a back view of the shredder with enclosure 2 and the exit slot 18 for shredded paper. FIG. 4 is a front view of the paper shredder 1 and the entry slot 19 for paper to be shredded.

Figure 5:
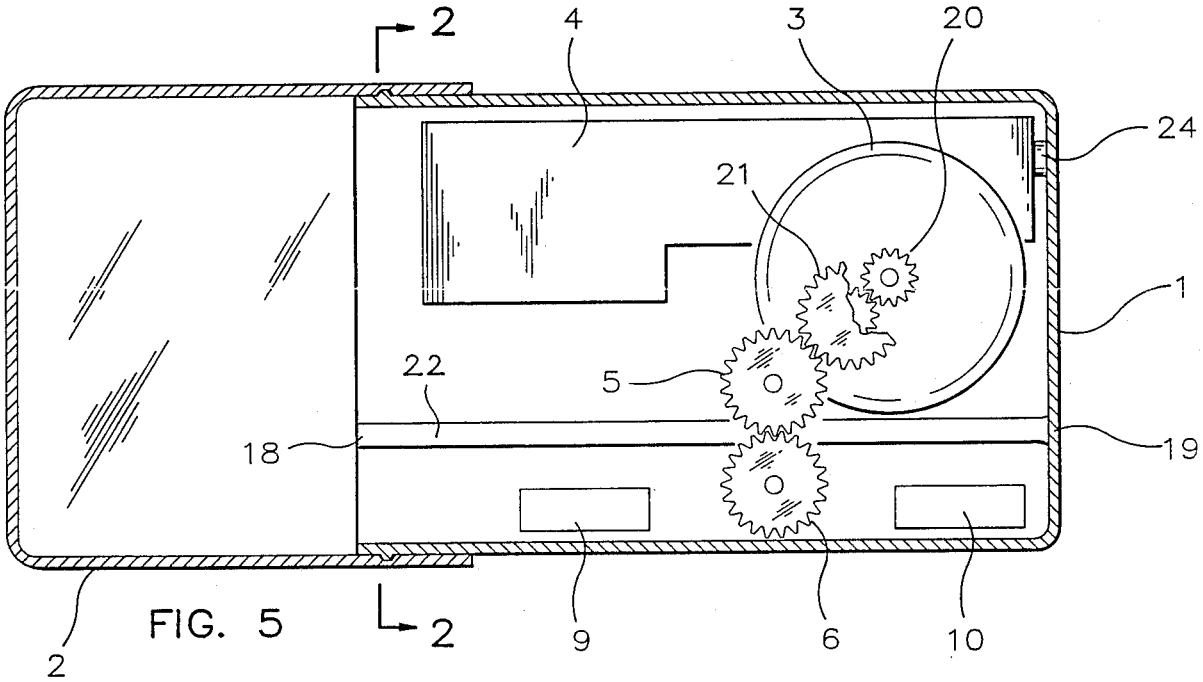
FIG. 5 is a sectional view through 1—1 of FIG. 1.

The sectional view of FIG. 5 shows the electric drive motor with output spur gear 20 engaging spur gear 21 which also engages spur gear 5. Spur gear 5 is axially mounted on the end of the paper feeding assembly shaft also engages spur gear 6 which is axially mounted on the shaft supporting the circular cutting knives. The longitudinal trough 22 guides paper from the entry slot 19 to the shredding assembly and then guides the paper shreds to the exit slot 18 which exits into the enclosure 2. The power module 4 is shown with a back view of the power switch 10, and the reverse switch 9.

Figure 6:
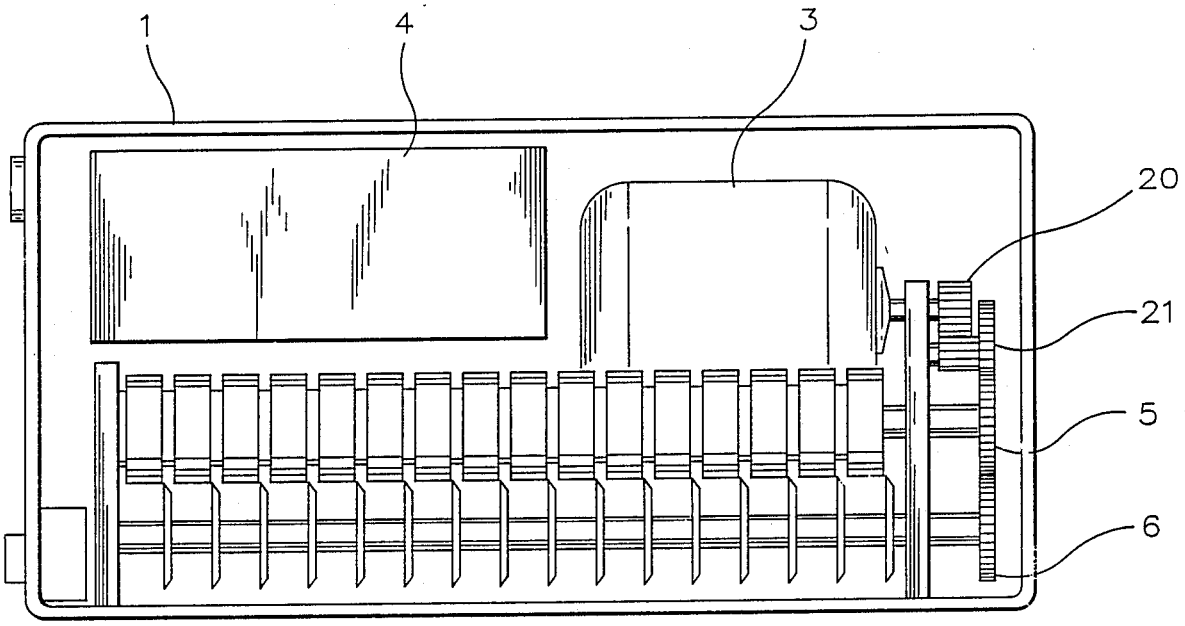
FIG. 6 is a sectional view through 2—2 of FIG. 5.

The sectional view of FIG. 6 shows the electric drive motor 3, the output gear 20 engaging the transfer gear 21, which engages the gear 5 on the paper drive shaft which engages the gear 6 on the rotating knife shaft.

Figure 7:
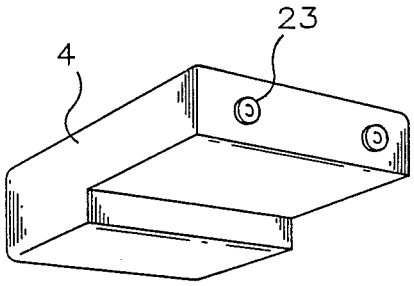
FIG. 7 is a perspective view of the power module.

FIG. 7 shows the power module 4 with external contacts 23 which match the case mounted contacts 24.

Figure 8:
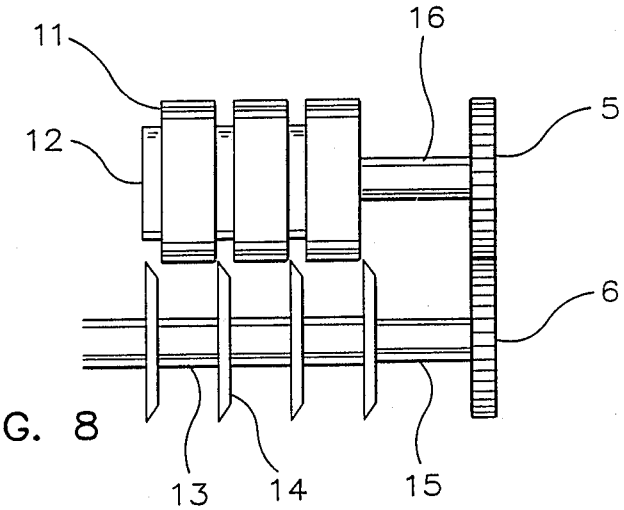
FIG. 8 is a detailed view of the paper shredding rolls.
Figure 9:
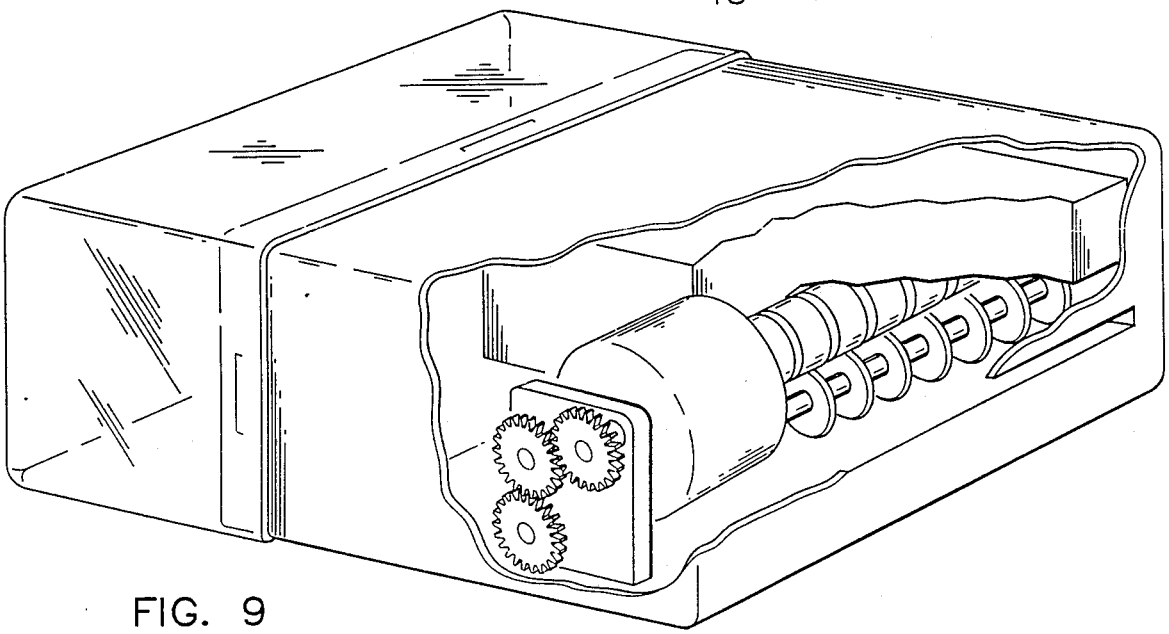
FIG. 9 is a top left perspective view of the pocket paper shredder.

FIG. 8 is an enlarged view of the paper drive shaft 16, with friction rollers 11 spacers 12 . The circular knife support shaft 15 is shown with knife blades 14 and spacers 13.

In operation paper to be shredded is inserted into slot 19 until it engages the paper feed rollers which pull the paper into the rotating knife blades where it is shredder and forced out the exit slot 18 into the enclosure 2.

I claim:

1. An electrically driven pocket size paper shredder for cutting paper documents into small strips wherein the improvement comprises:

a. a housing having a transverse paper receiving slot at the front end of the housing;
b. an enclosed longitudinal, horizontal,trough for guiding the entered papers;
c. the enclosed trough guiding the entered papers between two coacting transverse rotating shredder means;
d. a first rotatable shredder means having a circular, compressible, friction surface for pulling the entered papers through the shredding means;
e. the second rotatable shredding means having a plurality of flat circular knives separated by circular compressive, frictional spacers;
f. the first rotatable shredding means having axially spaced circumferential slots matching the cutting edges of the cutting knives on the second rotatable shredding means;
g. an enclosed horizontal trough guiding the shredded papers to an exit slot on the back of the shredder housing; and,
h. a removable container enclosure covering the exit slot for retaining the shredded papers.

2. A pocket size paper shredder according to claim 1 wherein the improvement further comprises:

a. the two coacting rotating paper shredding means intercoupled by associated gearing means;

b. the gearing means accommodating the output gear from an electric drive motor;

c. an electric power module for energizing the electric drive motor; and, d. the electric power module containing batteries or an electronic AC/DC power supply.

* * * * *